US006125753A

United States Patent [19]

Praet et al.

[11] Patent Number: 6,125,753

[45] Date of Patent: Oct. 3, 2000

[54] SLEEVE FOR A PRINTING MACHINE CYLINDER AND METHOD OF PUTTING THIS SLEEVE IN PLACE

[75] Inventors: Hervé Praet, Mulhouse; Jean-Pierre Moscato, La-Chapelle-Sous-Rougement; Gérard Rich, Orschwihr, all of France

[73] Assignee: Rollin S.A., Cernay, France

[21] Appl. No.: 09/085,943

[22] Filed: May 28, 1998

[30] Foreign Application Priority Data

May 28, 1997 [FR] France ..... 97 06546

[51] Int. Cl.[7] ..... B41F 13/10

[52] U.S. Cl. ..... 101/375; 101/217; 492/46

[58] Field of Search ..... 101/487, 375, 101/376, 217; 492/46; 118/244; 29/895.212

[56] References Cited

U.S. PATENT DOCUMENTS

| | | | |
|---|---|---|---|
| 3,981,237 | 9/1976 | Rhodes | 101/128.4 |
| 4,099,462 | 7/1978 | Coberley et al. | 101/153 |
| 4,198,739 | 4/1980 | Budinger et al. | 101/348 |
| 4,964,338 | 10/1990 | Fantoni et al. | 101/378 |
| 5,323,702 | 6/1994 | Vrotocoe et al. | 101/217 |
| 5,347,927 | 9/1994 | Berna et al. | 101/375 |
| 5,477,779 | 12/1995 | Kawabe | 101/487 |
| 5,553,541 | 9/1996 | Vrotacoe et al. | 101/217 |

FOREIGN PATENT DOCUMENTS

| | | |
|---|---|---|
| 12626595 | 1/1969 | European Pat. Off. . |
| 0613791 | 3/1994 | European Pat. Off. . |
| WO92/02859 | 2/1992 | WIPO . |

OTHER PUBLICATIONS

International Search Report dated Dec. 19, 1997 issued in PCT Application No. PCT/FR97/06546 filed May 28, 1997.

Patent Abstracts of Japan, vol. 012, No. 392 (M–755), Oct. 19, 1988, Publication No. 63141788, Published Jun. 14, 1988, Applicant Art Insatsu KK, Inventor Noguchi Sadami.

*Primary Examiner*—John S. Hilten
*Assistant Examiner*—Leslie J. Grohusky
*Attorney, Agent, or Firm*—Woodcock Washburn Kurtz Mackiewicz & Norris LLP

[57] ABSTRACT

A sleeve for a cylinder of a printing, coating or the like machine, comprising in particular a lithographic layer, a compressible layer, a support layer and, between the two last layers, a heat-shrinkable layer for permitting the adaptation of the sleeve to the diameter of a cylinder.

20 Claims, 2 Drawing Sheets

Fig. 1
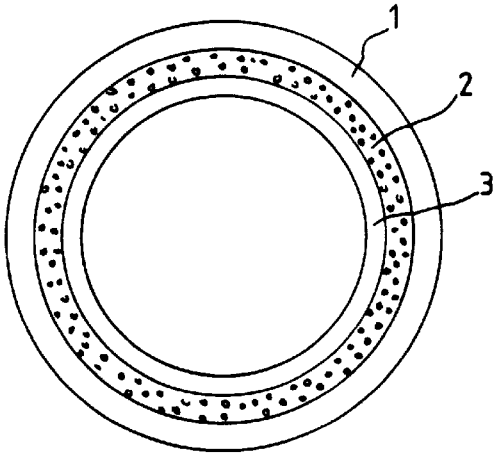
Fig. 2
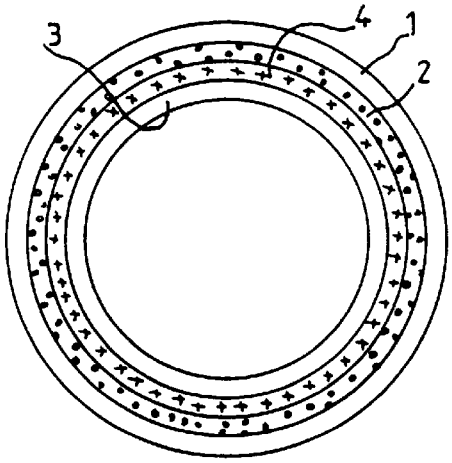
Fig. 3
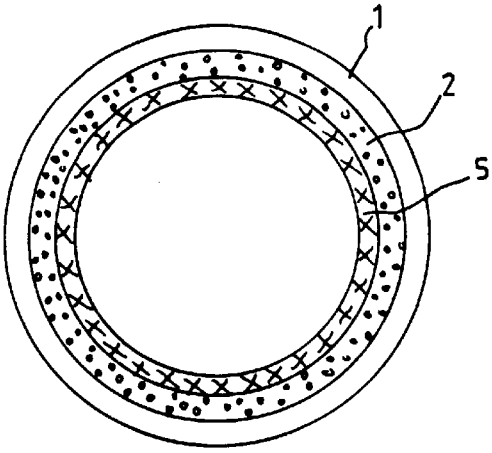
Fig. 4
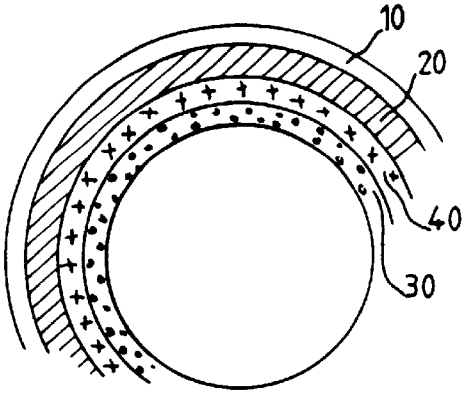
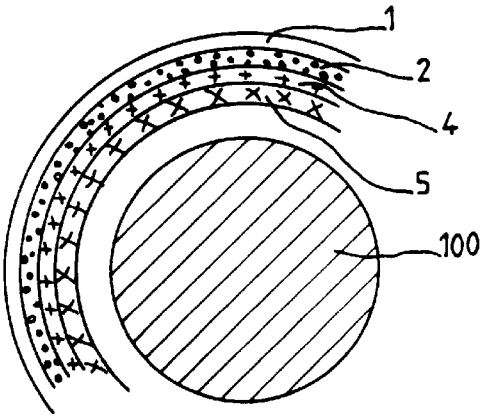
Fig. 5
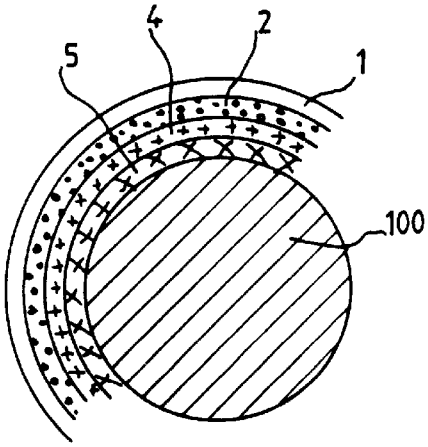
Fig. 6

SLEEVE FOR A PRINTING MACHINE CYLINDER AND METHOD OF PUTTING THIS SLEEVE IN PLACE

FIELD OF THE INVENTION

The present invention relates essentially to a removable or non-removable sleeve for a cylinder of a machine for printing, coating, embossing, squeezing-on or the like.

It is also directed to a method of putting in place this sleeve onto the aforesaid cylinder.

BACKGROUND OF THE INVENTION

One has already for a long time proposed multiple layer sleeves having various structures and intended to fit the cylinders of in particular offset printing machines.

In a general manner these sleeves consist of a plurality of associated concentric layers, namely essentially an outer printing or lithographic layer and one or several subjacent layers capable of providing the desired printing quality upon a substrate such for example as paper.

The known sleeves however exhibit a number of constraints in respect of their manufacture and of their use.

They should be custom-made in accordance with dimensions or sizes of the mandrels or cylinders of the machine onto which they have to be mounted. This requirement often needs the use of a specific manufacturing tooling and the manufacturing time is more or less long depending on the complexity of the structure of the multiple layer sleeve so that as a whole the manufacturing costs are relatively high.

Furthermore the known sleeves may not be adapted to the variable conditions of industrial utilization as well as to the variable diameters of the cylinders fitting the machines for printing, coating, or the like.

Therefore, the utilizer for fitting at the cylinders of his machine or for replacing the worn-out sleeves on these cylinders is compelled to proceed with the purchase of as many sleeves as there are cylinder diameters, which is not advantageous for him from the financial standpoint in particular.

Accordingly, the object of the present invention is to solve the problems referred to herein above by providing a sleeve which may be qualified as being universal in the sense that it is adaptable onto any cylinder diameter for a printing, coating or other machine.

SUMMARY OF THE INVENTION

For that purpose, the present invention provides a sleeve for a cylinder of a printing, coating or the like machine, comprising several associated concentric layers, namely an outer printing, coating or the like layer and one or several subjacent layers participating in the printing or coating quality of any support whatsoever, characterized in that at least one of the layers of the sleeve is shrinkable under heat so as to be adaptable to the diameter of the cylinder of the machine.

According to another characterizing feature of this sleeve, the heat-shrinkable layer is a layer having the technical shrinking function only.

According to another embodiment, the heat-shrinkable layer at the same time constitutes a layer having another function.

This heat-shrinkable layer may represent about 10 to 50% by volume of the layer having another function.

Thus, the heat-shrinkable layer could be integrated into an external printing, coating or the like layer, into a compressible layer, into a support layer or into at least two of these three layers.

The sleeve according to this invention is further characterized in that the aforesaid heat-shrinkable layer is made from a polyethylene-based, a polyvinylchloride(PVC)-based, a polyamide-based, a polypropylene-based or a flourinated polyvinylidene (PVDF)-based material.

According to still another characterizing feature of this sleeve, the inner-most layer of the said sleeve may comprise on its external surface a heat-fusible adhesive or a self-adhesive polymer layer for adhesively bonding the sleeve, after its shrinking, onto the cylinder.

It should further be specified here that the sleeve may consist of several independent concentrically imbricated parts one of which is permanently fixed onto the cylinder and at least another one of which is removable and comprises at east one heat-shrinkable layer.

The sleeve of this invention may be interrupted along a generating line and comprise a fastener for permitting its mounting onto the cylinder before the heat-shrinking.

In this case there could be provided a joining of the sleeve on the cylinder at the fastener for making the said sleeve functionally endless.

The sleeve with a heat-retractable layer or layers according to this invention may constitute an offset printing sleeve or also a flexographic printing sleeve.

In the latter case, it comprises, between a photopolymeric printing layer and a compressible cellular layer, a barrier layer which forms a heatshrinkable layer.

This invention is also directed to a method of putting in place a sleeve meeting the characterizing features referred to hereinabove, onto a cylinder of a printing, coating or the like machine, characterized by a heating of the sleeve onto the cylinder by means of a hot air convection or micro-wave system for activating the heat-shrinkable layer.

Thus after having put the sleeve in place on the cylinder, the sleeve having a greater diameter than that of the cylinder, the heating would cause the shrinking and the clamping of the sleeve onto the periphery of the cylinder, which sleeve therefore could be held quite simply by pressure upon the cylinder or also by adhesive bonding if the sleeve has an internal layer of adhesive.

BRIEF DESCRIPTION OF THE DRAWINGS

The invention will be better understood and further objects, characterizing features, details and advantages thereof will appear better as the following explanatory description proceeds with reference to the accompanying diagrammatic drawings given by way of a non-limiting example illustrating a specific presently preferred embodiment of the invention and in which:

FIGS. 1, 2 and 3 diagrammatically show in cross section sleeves for an offset printing machine cylinder according to this invention;

FIG. 4 is a diagrammatic view in partial cross section of a flexographic printing sleeve;

FIGS. 5 and 6 diagrammatically illustrate in partial cross section the putting in place of a sleeve onto a cylinder (FIG. 5) and the mounted position of the sleeve on this cylinder after heat-shrinking (FIG. 6)

DETAILED DESCRIPTION OF THE INVENTION

Figure 7:
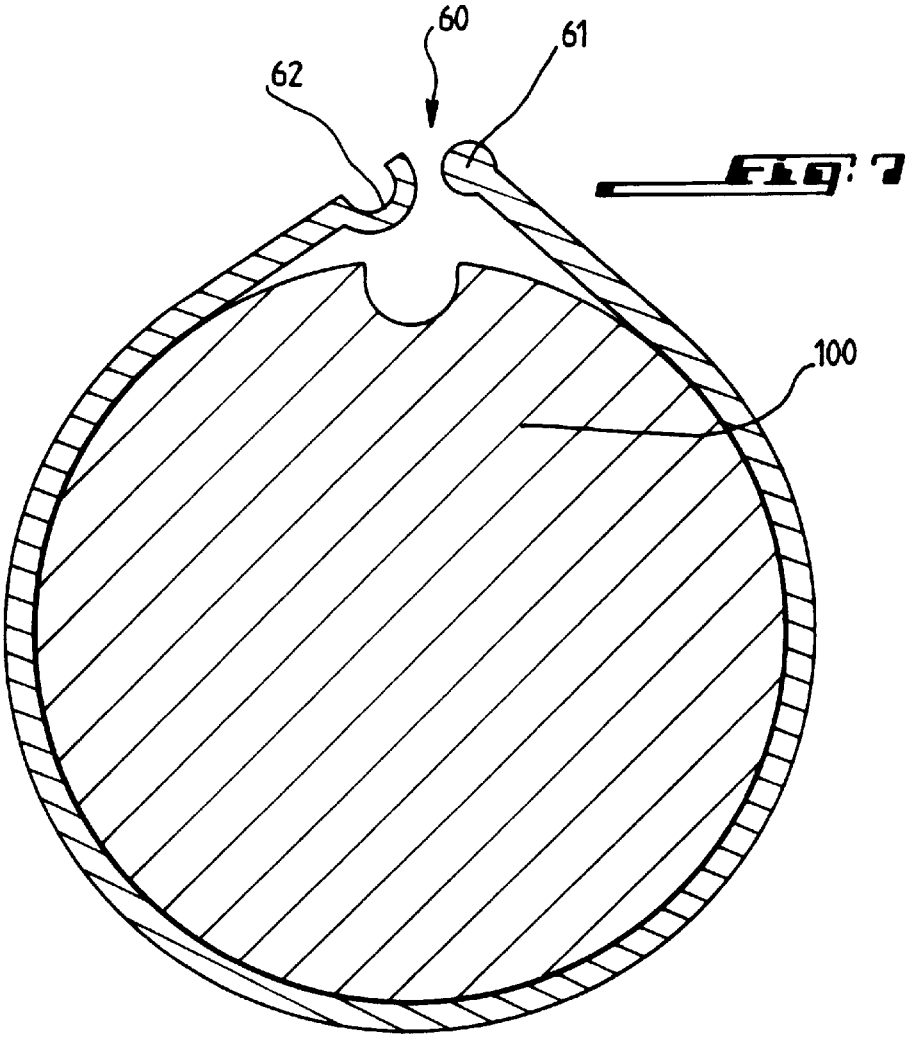
FIG. 7 shows in cross section a sleeve according to this intention provided with a fastener shown in a diagrammatic manner and in a position ready to be secured about a cylinder.

One will quite at first describe various embodiments of the offset printing sleeves with reference to FIGS. 1, 2 and 3.

FIG. 1 shows a sleeve with three layers, namely an external printing layer or lithographic layer 1, a compressible layer 2 which may be made from a cellular elastomer and any support layer 3 which will come in contact with the cylinder (not shown) FIGS. 1, 2 and 3.

According to the invention, at least one of the layers 1, 2 or 3 is integrated with a material imparting to it a heat-shrinkable character or property and constituting about 10 to 50% by volume of this layer. In other words, the layer at which the said material will be integrated, will preserve its function to which it is adapted and to which will be added the heat-shrinking function.

For that purpose, it will be possible for example to use alloys of polymers the heat-shrinkable phase of which has a rate of cristallinity lying between 10 and 60%.

For example, the material in question could be integrated into the layer 2 which therefore will be a compressible and heat-shrinkable layer.

According to the alternative embodiment shown in FIG. 2 which shows a multiple layer sleeve with a structure comparable with that shown in FIG. 1, there is shown at 4 a heat-shrinkable layer which is an additional layer, i.e. a layer possessing the technical shrinking function only.

This layer is interposed between the support layer 3 and the compressible layer 2 but it could as well be interposed without departing from the scope of the invention between the lithographic layer 1 and the compressible layer 2. Within the same gist, it is quite possible to provide two heat-shrinkable layers such as 4 between the layers 1 and 2 and the layers 2 and 3, respectively.

The heat-shrinkable layer(s) 4, whether independent of the other layers (FIG. 2) or whether integrated into one and/or the other of these other layers (FIG. 1) is or are made from a polyethylene-based, polyvinychloride(PVC)-based, polyamide-based, polypropylene-based or fluorinated polyvinylidene (PVDF)-based material or from other polymeric materials having a rate of cristallinity lying between 10 and 60% within a range of useful temperatures.

FIG. 3 shows a sleeve comprising a lithographic layer 1, a compressible layer 2 and a heatfusible adhesive layer 5 which replaces the support layer 3. Of course, as previously described, a heat-shrinkable layer (not shown here) could either be interposed between the layers 1 and 2 for example or be integrated into at least one of these two layers.

The adhesive layer 5 will permit as it will be described in detail later, the adhesive bonding of the sleeve, after heat-shrinking, onto the cylinder which has to be fitted with this sleeve.

One should further note here that the layer 5 may also be constituted by a layer of a self-adhesive polymer.

It should be added here that without departing from the scope of the invention, the sleeves shown in FIGS. 1, 2 and 3 could each comprise both kinds of heat-shrinkable layers, namely one layer or layers 4 having the technical shrinking function only as well as one or several heat-shrinkable layers integrated into at least one of the layers 1, 2 or 3.

FIG. 4 shows a flexographic printing layer which comprises from the outside towards the inside a photopolymeric layer 10 which generally comprises as known per se a backing (not shown) and a raised relieve portion constituting the printing part; a barrier layer 20 which imparts some mechanical stability to the sleeve during the rotation and which avoids the migration of the monomers of the photopolymeric layer 10 inwards of the sleeve; and a compressible layer 30 formed of a cellular elastomer.

The provision of the raised relief image on the photopolymeric sleeve preferably requires the application onto the external surface of the photopolymeric layer 10 of thin additional layers and this prior to its exposure to UV and to its being developed. These layers knows per se may be anti-adhesive layers protecting the surface during the contact with the UV mask or one or several layers permitting to generate the UV mask "in situ" on the sleeve or also layers for developing the contrast of the image or pertinent combinations thereof.

As with the offset sleeves illustrated by FIGS. 1, 2 and 3, one may provided one or several heat-shrinkable layers having the technical shrinking function only and interposed between the layers 10 and 20, 20 and 30. One has thus shown by way of example in FIG. 4 such a heat-shrinkable layer 40 interposed between the barrier layer 20 and the compressible layer.

A heat-shrinkable layer such as 40 could also be provided between the layers 10 and 20.

Likewise as described with reference to FIG. 1, at least one of the layers 20, 30 could in addition to its function which is its own one, be a heat-shrinkable layer.

According to a preferred embodiment, it is the barrier layer 20 between the photopolymeric layer 10 and the compressible layer 30 which will be made heat-shrinkable by incorporation of one and/or the other of the previously mentioned materials.

There will now be described the putting in place and the mounting of the sleeve according to the invention when referring more particularly to FIGS. 5 and 6.

On these figures has been diagrammatically and partially shown a sleeve comprising a lithographic layer 1, a compressible layer 2, a heat-shrinkable layer 4 and a layer 5 of heat-fusible adhesive or of self adhesive polymer.

As shown in FIG. 5 that the internal diameter of the multiple layer sleeve is greater than the diameter of the cylinder 100 so that the said sleeve may be easily slipped onto the cylinder 100.

One will then carry out a heating of the sleeve positioned on the cylinder by means of a hot air convection or microwave system for example (not shown) so that the heat-shrinkable layer 4 will be activated and at first cause the shrinking of the sleeve onto the cylinder 100 until it conforms to its external periphery and then its adhesive bonding onto the said periphery owing to the layer 5.

The layer 5 could of course be perfectly omitted without departing from the scope of the invention, as this has been explained previously.

Thus, as is understandably, a same size of sleeve could advantageously be adapted to various cylinder diameters.

The sleeves visible in FIGS. 1 to 6 are endless sleeves but one could perfectly provide a sleeve interrupted along one generating line thereof and comprising as seen in FIG. 7 a fastener 60 permitting its mounting onto the cylinder 100 before the heat-shrinkage.

Figure 8:
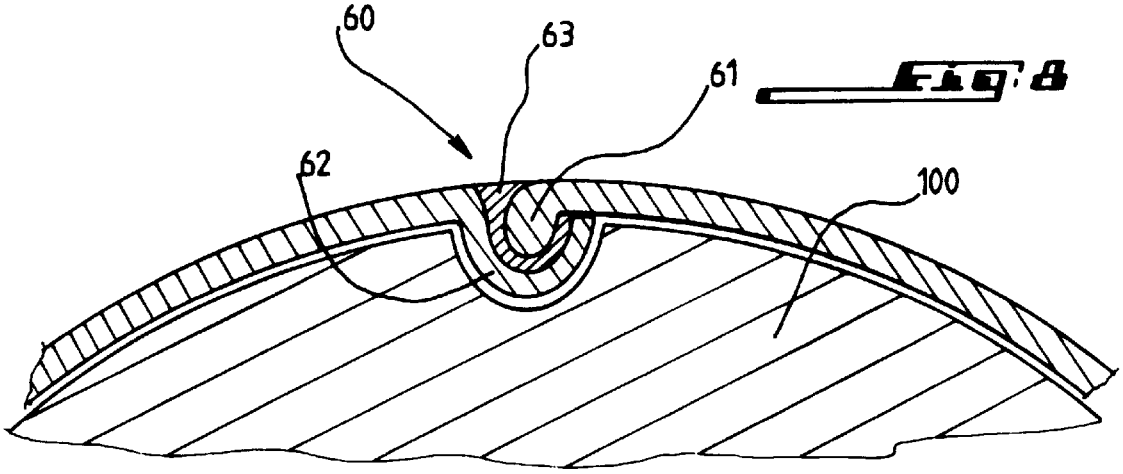
FIG. 8 is an enlarged partial view in cross section of the sleeve in the position fastened about the cylinder and comprising a joining at the fastener for making the sleeve functionally endless.

The fastener 60 could form a bead or rim 61 capable of being clipped into a groove 62 for thus carrying out the mounting of the sleeve about the cylinder as well seen in FIG. 8 whereafter the sleeve is heated for shrinking itself and conforming to the periphery of the cylinder 100.

FIG. 8 also shows that one could carry out through heat-fusion or melting a joining 63 of the sleeve onto the cylinder 100 at the fastener 60 so that a functionally endless sleeve would eventually be available.

The interrupted sleeve could also if need be be provided with a layer of heat-fusible adhesive (not shown) upon the face of contacting the cylinder 100 of the machine.

For making the sleeve according to this invention heat-shrinkable, one makes use of a technique known per se by proceeding in the following way:

The multiple layer sleeve with either one or several heat-shrinkable layers which are independent or integrated into the other layers is obtained through extrusion and cut to the desired length.

Then the sleeve is preferably reticulated or cross-linked and one heats it thereby permitting its radial expansion.

Then with a rate of expansion corresponding to the desired internal diameter, the sleeve is cooled thereby fixing its shape in the expanded state.

As previously described, the sleeve may then be put in place onto the cylinder having a smaller diameter and heated thereby causing its shrinkage and its mounting onto the periphery of the cylinder.

The invention is of course not at all limited to the embodiments described and illustrated which have been given by way of example only.

Thus, the sleeve of this invention could consist of several independent concentrically imbricated parts one of which would be permanently fixed onto the cylinder and at least another one of which would be removable and comprise one or several heat-shrinkable layers.

Likewise, the sleeve of the invention finds multiple applications for example in flexographic printing, photogravure printing, offset printing or for applications of coating and varnishing or lacquering.

This means that the invention comprises all the technical equivalents of the means described as well as their combinations if the latter are carried out according to its gist and within the scope of the appended claims.

What is claimed is:

1. An improved cylindrical sleeve adapted to be mounted onto a cylinder of a printing or coating machine of the kind wherein the sleeve comprises an outer layer for printing or coating and one or more inner layers concentric with the outer layer, the improvement characterized in that at least one of said sleeve layers comprises about 10–50 percent by volume of a heat-shrinkable material, whereby said heat-shrinkable material-containing layer is heat shrinkable, said heat-shrinkable layer securing said sleeve to said cylinder once said sleeve is mounted onto the cylinder and heat is applied.

2. A sleeve according to claim 1 wherein said inner layers include at least a compressible layer and an innermost support layer.

3. A sleeve according to claim 1 wherein said inner layers include at least a compressible layer or an innermost support layer.

4. A sleeve according to claim 1, which is interrupted along one generating line and comprises a fastener to permit its mounting onto the cylinder before the heat-shrinking.

5. A sleeve according to claim 4, comprising a joining of the said sleeve onto the cylinder at the fastener for making the said sleeve functionally endless.

6. A sleeve according to claim 1 wherein the heat-shrinkable material is a polymeric material having a rate of crystallinity between about 10 and about 60 percent.

7. A sleeve according to claim 6, wherein the polymeric material is selected from the group consisting of a polyethylene-based, polyvinylchloride (PVC)-based, polyamide-based, fluorinated polyvinylidene-based, and a polypropylene-based polymer.

8. A printing sleeve for a printing cylinder of a flexographic printing machine comprising:

an external polymeric printing layer;

an innermost supporting layer;

a compressible layer; and a barrier layer formed of heat-shrinkable material disposed between and concentric with the compressible layer and the support layer.

9. A sleeve according to claim 8, wherein the external polymeric printing layer is a photopolymeric layer.

10. A sleeve according to claim 8, wherein the heat-shrinkable material is a polymer having a rate of crystallinity between about 10 and about 60 percent.

11. A sleeve according to claim 10, wherein the polymer is selected from the group consisting of a polyethylene-based, polyvinylchloride (PVC)-based, polyamide-based, fluorinated polypropylene-based, and a polypropylene-based polymer.

12. The sleeve according to claim 8, wherein said sleeve is an offset printing sleeve.

13. A sleeve for a printing cylinder of a flexographic printing machine comprising:

an external polymeric printing layer;

one or more subjacent cylindrical concentric layers, at least one of which is compressible; and a barrier layer formed of heat-shrinkable material disposed between the polymeric printing layer and the compressible layer, whereby said barrier layer is heat-shrinkable, said heat-shrinkable barrier layer securing said sleeve to said cylinder once said sleeve is mounted onto the cylinder and heat is applied.

14. A sleeve according to claim 13, wherein the external polymeric printing layer is a photopolymeric layer.

15. A sleeve according to claim 13, wherein the heat-shrinkable material is a polymer having a rate of crystallinity between about 10 and about 60 percent.

16. A sleeve according to claim 15, wherein the polymer is selected from the group consisting of a polyethylene-based, polyvinylchloride (PVC)-based, polyamide-based, fluorinated polypropylene-based, and a polypropylene-based polymer.

17. The sleeve according to claim 13, wherein said sleeve is an offset printing sleeve.

18. A method for mounting a cylindrical printing or coating sleeve onto a cylinder of a printing or coating machine of the kind wherein the machine cylinder has a smaller diameter than the inner diameter of said sleeve, the method comprising the steps of providing a cylindrical sleeve comprising an outer layer for printing or coating and one or more inner layers concentric with the outer layer, wherein at least one of said sleeve layers comprises about 10–50 percent by volume of a heat-shrinkable material; and placing said sleeve onto the machine cylinder; and heating said sleeve to activate the heat-shrinkable material.

19. The method according to claim 18, wherein the heating step is accomplished by a hot air convection system.

20. The method according to claim 18, wherein the heating step is accomplished by a microwave system.

* * * * *